US009598794B2

(12) United States Patent
Isanhart

(10) Patent No.: US 9,598,794 B2
(45) Date of Patent: Mar. 21, 2017

(54) GARMENT FOR THERAPEUTIC COMFORT

(71) Applicant: Mary Lou Jo Isanhart, Evansville, IN (US)

(72) Inventor: Mary Lou Jo Isanhart, Evansville, IN (US)

( * ) Notice: Subject to any disclaimer, the term of this patent is extended or adjusted under 35 U.S.C. 154(b) by 150 days.

(21) Appl. No.: 14/532,568

(22) Filed: Nov. 4, 2014

(65) Prior Publication Data

US 2016/0120237 A1 May 5, 2016

(51) Int. Cl.

| | |
|---|---|
| ***D01D 5/253*** | (2006.01) |
| ***A41D 13/00*** | (2006.01) |
| ***D02G 3/44*** | (2006.01) |
| ***D01F 1/10*** | (2006.01) |
| ***D01F 6/90*** | (2006.01) |
| ***D01F 6/92*** | (2006.01) |
| ***A41D 13/005*** | (2006.01) |

(52) U.S. Cl.

CPC ..... *D01D 5/253* (2013.01); *A41D 13/0012* (2013.01); *A41D 13/0058* (2013.01); *D01F 1/10* (2013.01); *D01F 6/90* (2013.01); *D01F 6/92* (2013.01); *D02G 3/44* (2013.01)

(58) Field of Classification Search

CPC ..... A41D 13/0058; A41D 2400/10
USPC ..... 2/22, 69, 79, 227
See application file for complete search history.

(56) References Cited

U.S. PATENT DOCUMENTS

| | | | | |
|---|---|---|---|---|
| 5,826,273 | A * | 10/1998 | Eckes | A41D 13/0058 2/115 |
| 2006/0253954 | A1* | 11/2006 | Music | A41D 13/0051 2/115 |
| 2008/0201818 | A1* | 8/2008 | Nilforushan | A41D 13/005 2/69 |
| 2011/0041229 | A1* | 2/2011 | Niemi | A41D 13/0051 2/69 |
| 2011/0078840 | A1* | 4/2011 | Thompson | A41D 27/20 2/67 |
| 2012/0117713 | A1* | 5/2012 | Hoffner | A41D 27/20 2/227 |

* cited by examiner

*Primary Examiner* — Katherine Moran
(74) *Attorney, Agent, or Firm* — Gary K. Price

(57) ABSTRACT

A garment for therapeutic comfort to the wearer's lower body. The garment includes an outer layer that is usually of color or design in order to be aesthetically pleasing, and an inner layer that is in contact with the wearer when worn. The garment includes a plurality of upper and lower pocket members selectively positioned on the front, rear, outer, and inner sides of the garment, the pocket members each include a chamber in communication with an opening that can be in parallel or perpendicular with the length of leg portions of the garment. Each of the pocket members are defined between the outer and inner sides of the garment, and are seized for receiving a cold compression.

13 Claims, 4 Drawing Sheets

GARMENT FOR THERAPEUTIC COMFORT

CROSS REFERENCES TO RELATED APPLICATIONS

U.S. Provisional Application for Patent No. 61/899,534, filed Nov. 4, 2013, with title "Garment for Therapeutic Comfort" which is hereby incorporated by reference. Applicant claims priority pursuant to 35 U.S.C. paragraph 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The present invention relates to a garment worn on a user's body having means for receiving heated or cooled packs to provide comfort to the user's lower body.

2. Brief Description of Prior Art

Many people suffer the discomfort of swelling and/or tenderness in the lower body region following surgery, as well as other type procedures and conditions that result in such discomfort. Doctors often recommend warm or cold therapy that is intended to be retained in position over the area of discomfort. However, often the available warm or cold therapy fail to conveniently fit over the desired area.

It should be appreciated that there exists a continuing need for a comfortable fitting garment that is stylish yet designed to receive cold therapy or warm therapy to give comfort to the wearer experiencing discomfort. The present invention fulfills these needs and provides further related advantages.

SUMMARY OF THE INVENTION

A garment for therapeutic comfort to the wearer's lower body. The garment includes an outer layer that is usually of color or design in order to be aesthetically pleasing, and an inner layer that is in contact with the wearer when worn. The garment includes a plurality of upper and lower pocket members selectively positioned on the front, rear, outer, and inner sides of the garment. The pocket members each include a chamber in communication with an opening to the pocket member. The openings can be in parallel or perpendicular with the length of the leg portions of the garment. Each of the pocket members described are defined between the outer and inner layers of the garment.

In application, the wearer places the garment on the wearer's body as typically worn on the lower body. When worn, the pocket members as described are positioned and in contact with selected areas on the wearer's body. If cold compression is desired, cooling packs are inserted in the chamber through the openings of the selected pocket members. As a consequence, the cooling packs are positioned between the wearer's body and the inner and outer layers. In this regard, the cooling members are positioned in order to cover the selected area on the wearer's body. Similarly, if warm compression is desired, warming members are inserted into the pocket members and positioned between the wearer's body and the inner and outer layers.

DESCRIPTION OF THE PREFERRED EMBODIMENT

Figure 1:
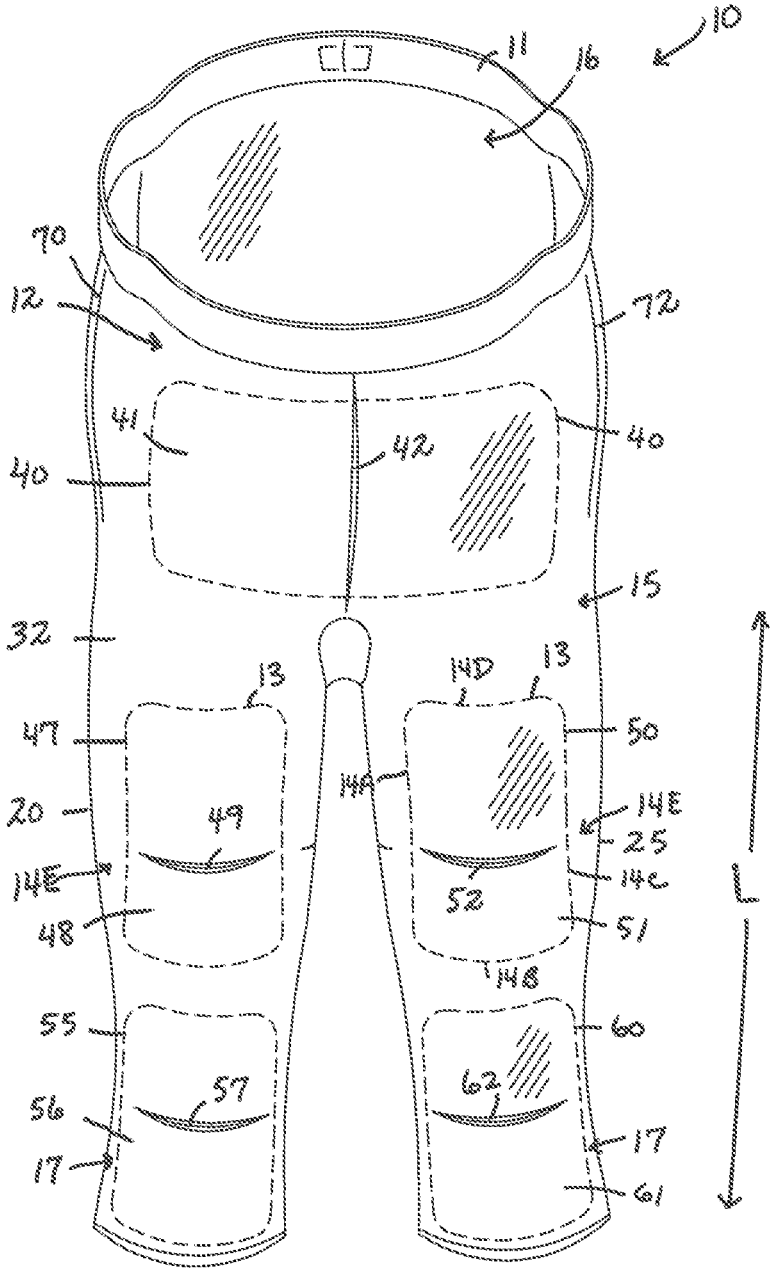
FIG. 1 is a front perspective view of a preferred embodiment of the present invention, a garment for therapeutic comfort, the broken lines showing the location of defined chamber members.
Figure 2:
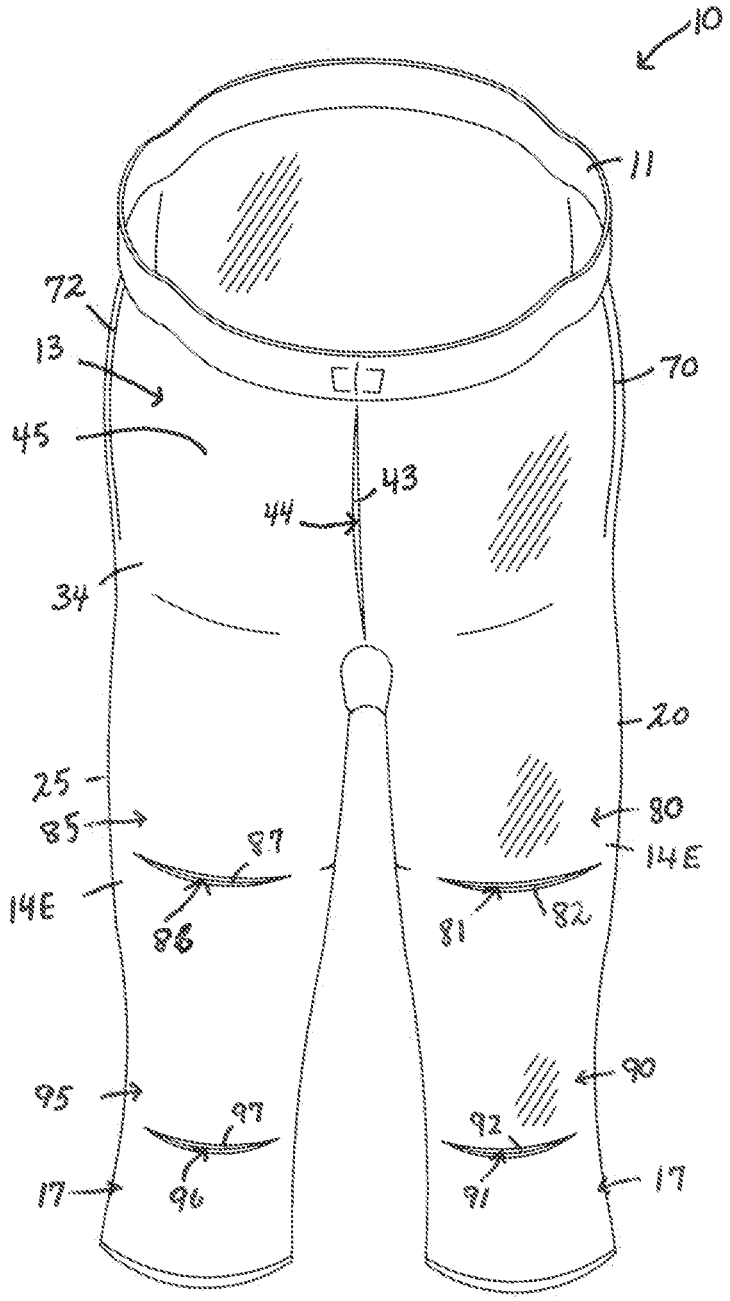
FIG. 2 is a rear view of the garment of FIG. 1.
Figure 3:
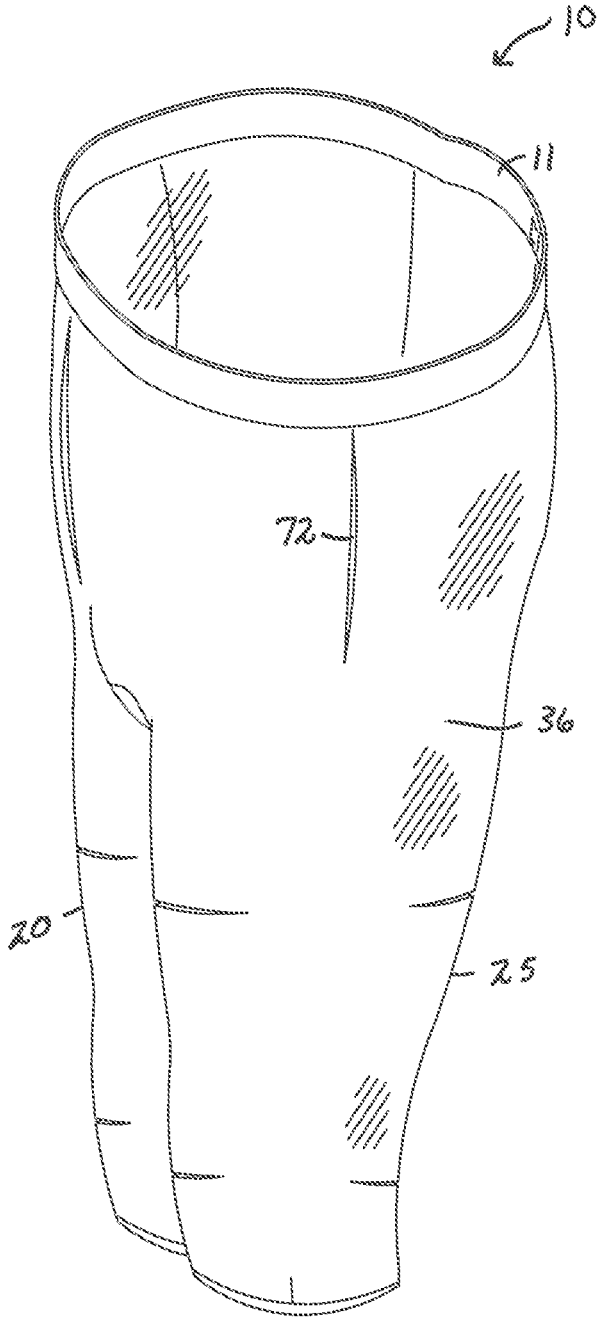
FIG. 3 is a side view of the garment of FIG. 1.

In accordance with the present invention, a garment for therapeutic comfort is disclosed. The garment is directed to an article of clothing covering the legs and wearer's mid-section and includes means for receiving cold therapy or warm therapy to provide comfort to the wearer. Specifically, it will be noted in the drawings that the garment of the present invention provides a means to comfortably wear hot and cold therapy packs known in the art to relieve discomfort. In the broadest context, the garment of the present invention consists of components configured and correlated with respect to each other so as to attain the desired objective.

FIGS. 1-4 illustrate a preferred embodiment of a garment 10 made in accordance with the present invention. It should be noted that the garment 10 illustrated in the drawings illustrates a particular style of pants known in the art. It is understood that any article of clothing typically worn on the wearer's lower body such as short pants, full-length pants, and the like is appropriate. The garment 10 preferrably having a shell made from a stretchable, washable material that is close-fitting and covers the legs and wearer's mid-section. The garment 10 preferrably has an adjustable fastening system 11 along the mid-section to allow for variable sizing and a snug fit.

As is typical with articles of clothing, the garment 10 includes an outer layer 15 that is usually of color or design in order to be aesthetically pleasing, and an inner layer 16 that is in contact with the wearer when worn.

As stated, the garment 10 includes a main body portion that is configured to be worn at least a portion of the wearer's mid-section, hips and at least a portion of the legs. As illustrated, the main body portion includes first and second leg portions 20, 25, respectively, that each define a length "L".

Figure 4:
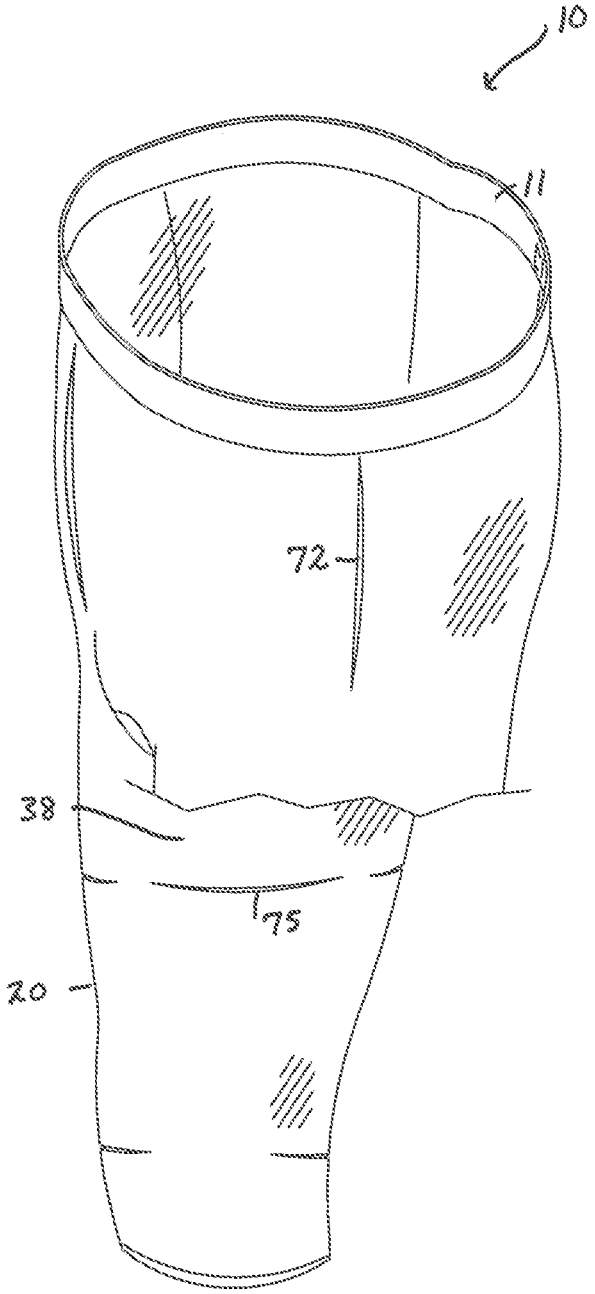
FIG. 4 is a side view showing the inner side of the garment's first leg portion.

The garment 10 includes a plurality of upper and lower pocket members positioned on the front side 32 of the garment (FIG. 1), on the rear side 34 of the garment (FIG. 2), on the outer side 36 of the garment (FIG. 3), and on the inner side 38 of the garment (FIG. 4).

Referring to FIG. 1, the front side 32 includes an upper pocket member 40 disposed on an upper portion 12 of the garment 10 to cover the wearer's mid-section. The pocket 40 includes a chamber 41 in communication with an opening 42. As illustrated, the pocket opening 42 is parallel with the length L of the leg portions 20, 25.

Similarly, the upper portion 13 of the rear side 34 of the garment 10 includes an opening 43 for access to a second chamber 44 for second pocket member 45, which opening 43 is parallel with the length L.

Referring again to FIG. 1, a third pocket member 47 is positioned on the front side 32 of the garment 10, on the first leg portion 20 at a location 14E, over the wearer's knee area. The third pocket 47 includes a chamber 48 in communication with an opening 49 to access the chamber 48. As illustrated, the opening 49 is perpendicular with the length L of the leg portion 20.

A fourth pocket member 50 is positioned on the front side 32 of the garment 10, on the second leg portion 25 at the location 14E, over the wearer's knee area. The fourth pocket 50 includes a chamber 51 in communication with an opening 52 to access the chamber 51. As illustrated, the opening 52 is perpendicular with the length L of the leg portion 25.

The front side 32 of the garment 10, on the first leg portion 20, further includes a fifth pocket member 55, at a location 17 approximately above the wearer's ankle. The fifth pocket 55 includes a chamber 56 in communication with an opening 57 to access the chamber 56. As illustrated, the opening 57 is perpendicular with the length L of the leg portion 20.

A sixth pocket member 60 is positioned on the front side 32 of the garment 10, on the second leg portion 25, at the location 17 approximately above the wearer's ankle. The sixth pocket member 60 includes a chamber 61 in communication with an opening 62 to access the chamber 61. As illustrated, the opening 62 is perpendicular with the length L of the leg portion 25.

The outer side 36 of the garment 10 includes a first outer opening 70 disposed on the upper portion 12 adjacent the first leg portion, that is parallel with the length L. The first outer opening 70 is in further communication with the chamber 41 of pocket member 40 illustrated in FIG. 1, and in communication with the chamber 44 of pocket member 45 illustrated in FIG. 2.

Similarly, the outer side of the garment 10 includes a second outer opening 72 disposed on the upper portion 12 adjacent the second leg portion 25, that is parallel with the length L. The second outer opening 72 is in further communication with the chamber 41 of pocket member 40 illustrated in FIG. 1, and in communication with the chamber 44 of pocket member 45 illustrated in FIG. 2.

As illustrated in FIG. 4, the inner side 38, of the first leg portion 20 includes an opening 75 in communication with the chamber 48 of the third pocket member 47. As illustrated, the opening 75 is perpendicular with the length L of the leg portion 20. Similarly, but not shown in the drawings, the inner side 38 of the second leg portion 25 includes an opening (not shown) in communication with the chamber 51 of pocket member 50.

Each of the chambers described, are defined between the outer layer 15 and the inner layer 16 of the garment 10. Seam 13 (see FIG. 1) is formed by stitching or heat-seal for example, and fastens the pocket ends 14A, 14B, 14C, and 14D between the layers 15, 16. Further, and as illustrated, unlike the known pockets where the opening is positioned at the upper end of the pocket, the present invention discloses a pocket member with an opening disposed in the approximate center of the pocket.

In the preferred embodiment, the rear side 34 of the garment 10 further includes a seventh pocket 80 on the first leg portion 20 disposed over the back of the wearer's knee area 14E. The seventh pocket 80 includes a chamber 81 in communication with an opening 82 to access the chamber 81. The opening 82 is perpendicular with the length L of the leg portion 20. Similarity, an eighth pocket 85 is positioned on the second leg portion 25 over the back of the wearer's knee area 14E. The eighth pocket 85 includes a chamber 86 in communication with an opening 87 to access the chamber 86. The opening 87 is perpendicular with the length L of the leg portion 25.

The rear side 34 on the first leg portion 20 further includes a ninth pocket 90 at the location 17 approximately above the wearer's ankle. The ninth pocket 90 includes a chamber 91 in communication with an opening 92 to access the chamber 91. The opening 92 is perpendicular with the length L of the first leg portion 20. Similarly, a tenth pocket member 95 is positioned on the rear side 34, on the second leg portion 25, at the location 17 approximately above the wearer's ankle. The tenth pocket 95 includes a chamber 96 in communication with an opening 97 to access the chamber 96. As illustrated, the opening 97 is perpendicular with the length L of the second leg portion 25.

The operation of the garment 10 for therapeutic comfort will now be described. The wearer places the garment 10 on the wearer's body as typically worn on the lower body. When worn, the pocket members as described are positioned and in contact with selected areas on the wearer's body.

For purposes of example, if cold compression is desired over the wearer's right knee area, cooling packs (not shown) are inserted in the chamber 48 through the opening 49. As a consequence, the cooling pack(s) are positioned between the wearer's body (knee area) and the inner and outer layers 16, 15 respectively. In this regard, the cooling pack(s) are positioned in order to cover the selected area on the wearer's body. Similarly, if warm compression is desired, warming members are inserted into the selected pocket members and positioned between the wearer's body and the inner and outer layers 16, 15 respectively.

As described the garment is form-fitting such that once the selected pack(s) are positioned within the selected chamber(s), the pack(s) will stay in place.

While the preferred embodiment of the invention has been shown, illustrated, and described, it would be apparent to those skilled in this field that various modifications may be made in these embodiments without departing from the spirit of the present invention. Thus, the scope of the invention should be determined by the appended claims in the formal application and their legal equivalence, rather than by the examples given.

I claim:

1. A garment for therapeutic comfort to the wearer's lower body, said garment comprising:

a main body portion having an outer layer, and an inner layer that is in contact with a wearer, said main body portion including first and second leg portions that define a length, a plurality of upper and lower pocket members selectively positioned on a front, rear, outer, and inner sides of the garment, said plurality of upper and lower pocket members include a first pocket member disposed on the front side at an upper location configured to cover the wearer's mid-section, said first pocket member including a first chamber and a first opening for accessing said first chamber from an outside of the garment, said first opening is parallel with said length, and wherein said first pocket member defines a first pocket length that is perpendicular to said length, and said first opening is disposed at an approximate halfway point of said first pocket length such that said first opening accesses a first end of said first chamber and an opposite end of said first chamber, a second pocket member disposed on the rear side of the garment configured to cover the wearer's upper rear-section, said second pocket member including a second chamber and a second opening for accessing said second chamber from the outside of the garment, said second opening is parallel with said length, and wherein said second pocket member defines a second pocket length that is perpendicular to said length, and said second opening is disposed at an approximate halfway point of said second pocket length such that said second opening accesses a first end of said second chamber and an opposite end of said second chamber, a third pocket member disposed on the front side at a first location along the length of the first leg portion that is configured to be over the wearer's knee area, said third pocket member including a third chamber and a third opening for accessing said third chamber from an outside of the garment, said third opening is perpendicular to said length, and wherein said third pocket member defines a third pocket length that is parallel to said length, and said third opening is disposed at an approximate halfway point of said third pocket length such that said third opening accesses a first end of said third chamber and an opposite end of said third chamber, a fourth pocket member disposed on the front side at a second location along the length of the second leg portion that is configured to be over the wearer's knee area, said fourth pocket member including a fourth chamber and a fourth opening for accessing said fourth chamber from the outside of the garment, said fourth opening is perpendicular to said length, and wherein said fourth pocket member defines a fourth pocket length that is parallel to said length, and said fourth opening is disposed at an approximate halfway point of said fourth pocket length such that said fourth opening accesses a first end of said fourth chamber and an opposite end of said fourth chamber, a fifth pocket member disposed on the front side at a third location along the length of the first leg portion that is configured to be above the wearer's ankle, said fifth pocket member including a fifth chamber and a fifth opening for accessing said fifth chamber from the outside of the garment, said fifth opening is perpendicular to said length, and wherein said fifth pocket member defines a fifth pocket length that is parallel to said length, and said fifth opening is disposed at an approximate halfway point of said fifth pocket length such that said fifth opening accesses a first end of said fifth chamber and an opposite end of said fifth chamber, a sixth pocket member disposed on the front side at a fourth location along the length of the second leg portion configured to be above the wearer's ankle, said sixth pocket member including a sixth chamber and a sixth opening for accessing said sixth chamber from the outside of the garment, said sixth opening is perpendicular to said length, and wherein said sixth pocket member defines a sixth pocket length that is parallel to said length, and said sixth opening is disposed at an approximate halfway point of said sixth pocket length such that said sixth opening accesses a first end of said sixth chamber and an opposite end of said sixth chamber, wherein a first outer side of said main body portion including a first outer opening disposed on an upper portion of the main body, said first outer opening in communications with said first and second chambers, and a second outer side disposed on said upper portion including a second outer opening in communications with said first and second chambers, wherein each of said chambers are defined between said inner layer and outer layers, and wherein the inner and outer layers are made from a stretchable material that is form-fitting.

2. The garment as recited in claim 1, further including a seventh pocket member on the rear side at said first location and configured to be over the back of the wearer's knee area, said seventh pocket member including a seventh chamber and a seventh opening for accessing said seventh pocket chamber from the outside of the garment, said seventh opening perpendicular to said length, and wherein said seventh pocket member defines a seventh pocket length that is parallel to said length, and said seventh opening is disposed at an approximate halfway point of said seventh pocket length such that said seventh opening accesses a first end of said seventh chamber and an opposite end of said seventh chamber, and an eighth pocket member on the said rear side at said second location and configured to be over the back of the wearer's knee area, said eighth pocket member including an eighth chamber and an eighth opening for accessing said eighth pocket chamber from the outside of the garment, where said eighth opening perpendicular to said length, and wherein said eighth pocket member defines an eighth pocket length that is parallel to said length, and said eighth opening is disposed at an approximate halfway point of said eighth pocket length such that said eighth opening accesses a first end of said eighth chamber and an opposite end of said eighth chamber.

3. The garment as recited in claim 2, further including a ninth pocket member on the rear side at said third location and configured to be above the wearer's ankle, said ninth pocket member including a ninth chamber and a ninth opening for accessing said ninth chamber from the outside of the garment, wherein said ninth opening is perpendicular to said length, and wherein said ninth pocket member defines a ninth pocket length that is parallel to said length, and said ninth opening is disposed at an approximate halfway point of said ninth pocket length such that said ninth opening accesses a first end of said ninth chamber and an opposite end of said ninth chamber, and a tenth pocket member on the rear side at said fourth location and configured to be above the wearer's ankle, said tenth pocket member including a tenth chamber and a tenth opening for accessing said tenth chamber from the outside of the garment, said tenth opening perpendicular to said length, and wherein said tenth pocket member defines a tenth pocket length that is parallel to said length, and said tenth opening is disposed at an approximate halfway point of said tenth pocket length such that said tenth opening accesses a first end of said tenth chamber and an opposite end of said tenth chamber.

4. The garment as recited in claim 1, further comprising an adjustable fastener for fastening said main body portion about the wearer.

5. The garment as recited in claim 4, wherein said fastener adapted to be disposed along the wearer's mid-section to allow for variable sizing and snug fit.

6. A garment for therapeutic comfort to the wearer's lower body, said garment comprising:

a main body portion having an outer layer, and an inner layer that is in contact with a wearer, said main body portion including first and second leg portions and a front side, a rear side, an outer side, and an inner side, and wherein said main body portion defines a length, a first pocket member disposed on the front side at an upper location configured to cover the wearer's mid-section, said first pocket member including a first chamber and a first opening for accessing said first chamber from an outside of the garment, and wherein said first pocket member defines a first pocket length that is perpendicular to the length, and said first opening is disposed at an approximate halfway point of said first pocket length such that said first opening accesses a first end of said first chamber and an opposite end of said first chamber, a second pocket member disposed on the rear side of the garment configured to cover the wearer's upper rear-section, said second pocket member including a second chamber and a second opening for accessing said second chamber from the outside of the garment, and wherein said second pocket member defines a second pocket length that is perpendicular to said length, and said second opening is disposed at an approximate halfway point of said second pocket length such that said second opening accesses a first end of said second chamber and an opposite end of said second chamber, a third pocket member disposed on the front side at a first location along the length of the first leg portion that is configured to be over the wearer's knee area, said third pocket member including a third chamber and a third opening for accessing said third chamber from the outside of the garment, a fourth pocket member disposed on the front side at a second location along the length of the second leg portion that is configured to be over the wearer's knee area, said fourth pocket member including a fourth chamber and a fourth opening for accessing said fourth chamber from the outside of the garment.

7. The garment as recited in claim 6, further including a fifth pocket member disposed on the front side at a third location along the length of the first leg portion that is configured to be above the wearer's ankle, said fifth pocket member including a fifth chamber and a fifth opening for accessing said fifth chamber from the outside of the garment, and a sixth pocket member disposed on the front side at a fourth location along the length of the second leg portion and configured to be above the wearer's ankle, said sixth pocket member including a sixth chamber and a sixth opening for accessing said sixth chamber from the outside of the garment.

8. The garment as recited in claim 7, further including a first outer side including a first outer opening disposed on an upper portion of the main body, said first outer opening in communications with said first and second chambers, and a second outer side disposed on said upper portion including a second outer opening in communications with said first and second chambers.

9. The garment as recited in claim 8, further including a seventh pocket member on the rear side at said first location and configured to be over the back of the wearer's knee area, said seventh pocket member including a seventh chamber and a seventh opening for accessing said seventh chamber from the outside of the garment, and an eighth pocket member on the said rear side at said second location and configured to be over the back of the wearer's knee area, said eighth pocket member including an eighth chamber and an eighth opening for accessing said eighth chamber from the outside of the garment.

10. The garment as recited in claim 9, further including a ninth pocket member on the rear side at said third location and configured to be above the wearer's ankle, said ninth pocket member including a ninth chamber and a ninth opening for accessing said ninth chamber from the outside of the garment, and a tenth pocket member on the rear side at said fourth location and configured to be above the wearer's ankle, said tenth pocket member including a tenth chamber and a tenth opening for accessing said tenth chamber from the outside of the garment.

11. The garment as recited in claim 10, wherein each of said chambers are defined between said inner layer and outer layer, and wherein the inner and outer layers are made from a stretchable material that is form-fitting.

12. The garment as recited in claim 11, further comprising an adjustable fastener for fastening said main body portion about the wearer.

13. The garment as recited in claim 12, wherein said fastener adapted to be disposed along the wearer's mid-section to allow for variable sizing and snug fit.

* * * * *